United States Patent [19]

Bense et al.

[11] Patent Number: 5,069,578

[45] Date of Patent: Dec. 3, 1991

[54] METHOD AND DEVICE FOR PRODUCING A SURFACE COATING ON A SURFACE SUCH AS A ROAD

[75] Inventors: Pierre Bense, Frouard; Jean-Francois Patte, Saint Max, both of France

[73] Assignee: Screg Routes Et. Travaux Publics, Yvelines Cedex, France

[21] Appl. No.: 556,256

[22] Filed: Jul. 19, 1990

[30] Foreign Application Priority Data

Jul. 21, 1989 [FR] France ..... 89 09893

[51] Int. Cl.[5] ..... E01C 7/06; E01C 7/32; E01C 3/06

[52] U.S. Cl. ..... 404/75; 404/92

[58] Field of Search ..... 404/72-75, 404/77, 92, 80

[56] References Cited

U.S. PATENT DOCUMENTS 4,011,023 3/1977 Cutler .
4,124,325 11/1978 Cutler ..... 404/75

FOREIGN PATENT DOCUMENTS 0132202 1/1985 European Pat. Off. .
0292337 11/1988 European Pat. Off. .
0316752 5/1989 European Pat. Off. .
2550248 7/1983 France .
396625 8/1933 United Kingdom .

OTHER PUBLICATIONS

Complete Specification-Improved Manufacture of Bituminous Compositions, No. 682B, Gr. Britian.

*Primary Examiner*—Ramon S. Britts
*Assistant Examiner*—Nancy P. Connolly
*Attorney, Agent, or Firm*—Wenderoth, Lind & Ponack

[57] ABSTRACT

The method comprises spreading a layer of bituminous binding material on the surface, spreading at least one layer of aggregates on the layer of binding material, and compacting the layer of aggregates in contact with the layer of binding material. The aggregates consist of loose chips covered with a mixture, which has a pasty consistency, of bitumen and of pulverulent material. The layer of binding material contains at least 11% of the total quantity of bitumen used in the coating. The operations of spreading the binding material and the aggregates and of compacting and surfacing the coating are performed in succession within a period of less than 5 seconds, the speed of advance of the site being at least ten meters per minute. An integral mobile device carrying a bitumen-spraying boom and a finishing table fixed to the rear part of the chassis makes it possible to produce a coating according to the invention using aggregates which are coated with bitumen produced by the device or transported thereby to the rear part of the chassis between the spraying boom and the finishing table.

17 Claims, 3 Drawing Sheets

METHOD AND DEVICE FOR PRODUCING A SURFACE COATING ON A SURFACE SUCH AS A ROAD

BACKGROUND OF THE INVENTION

The invention relates to a method and device for producing a surface coating consisting of aggregates and bitumen on a surface such as a road.

Worn or damaged roads may be repaired by producing, on the surface of this road, a surface coating based on aggregates, such as loose chips and bitumen.

The current technique for producing a surface coating includes spraying the road with a thick layer of bituminous binding material (for example a layer of 1.3 to 1.8 kg of bitumen per square meter of road). Then, loose chips, such as crushed rocks, are poured onto the binding material in a quantity which is excessive relative to the quantity required to just cover the road. Finally, compactors are used to ensure the best adhesion possible for the loose chips on the layer of bituminous binding material.

It is necessary to pour, onto the layer of bituminous binding material, a quantity of loose chips which is greater than the quantity required to just cover the layer of binding material so that there is no exposed bituminous binding material remaining to adhere to the tires of vehicles.

Those aggregates which do not adhere to the bitumen are thrown in all directions by vehicles travelling on the road and can cause the windscreens of other vehicles to shatter and paintwork to be chipped as well as, in urban areas, windows to be shattered.

Moreover, the cost of the coating produced in this manner is increased by virtue of the fact that good-quality loose chips are wasted.

This loss of loose chips just after the coating has been laid on the road constitutes what is known as operational rejection.

There is also another type of rejection which is postponed until during the weeks following the laying of the coating and which consists of a progressive tearing away of the poorly adhered loose chips or of those loose chips which have adhered over too small a part of their surface.

Finally, in the first period of cold weather following the laying of the coating, there will be a rejection known as first-winter rejection which occurs due to the fact that the aggregates which adhered satisfactorily when the binding material was still plastic are bound in a fragile manner and, when the first cold spell arrives become brittle. Travelling vehicles remove the small percentage of loose chips whose adhesion has not withstood the first cold spell.

One year after laying of the coating, the loose chips which have withstood all the tests of the traffic under the various weather conditions experienced during the year are henceforth satisfactorily fixed and generally do not detach themselves further except when they are worn and when the adhesive binding material becomes too old.

In order to withstand tearing away, the loose chips which are poured onto the binding material must have as large a surface as possible in contact with the adhesive binding material. Because the crushed loose chips do not have simple geometric shapes, such as the shape of a cube or the shape of a truncated pyramid, a point of a loose chip is often located opposite a face thereof.

When the loose chips are disposed so as to have a point facing upwards, the corresponding disposition affords advantages in that the tires of vehicles grip well in wet weather. On the other hand, this leads to more rapid wear of the tires and to noise being produced due to the contact of the tires with the ridges or points of the loose chips.

When loose chips are poured onto a layer of adhesive bituminous binding material, good and durable adhesion is produced only when the following conditions are fulfilled:

the loose chips must not be dusty or contaminated with soil, and must be dry, which is rarely the case, and, similarly, the surface of the road must be clean and dry;

the adhesive bituminous binding material must be sufficiently fluid to spread and moisten the loose chips, which requires the coating to be produced during a period of sufficiently hot weather. This limits the period during which surface coating can be laid to repair roads, in the geographical zone to which France belongs, to the five warmest months of the year, from May to September.

The coating technique, implemented according to known methods, is thus risky, since it is sufficient for there to be excessive humidity, rain, a cold spell, for dirty loose chips to be used or for a road surface to be contaminated with soil, for the coating produced on the site to be of insufficient quality.

Roads which have to be repaired usually have a defective longitudinal or transverse profile which is impossible to rectify using known techniques for producing surface coatings. In fact, by applying a layer of binding material on a deformed support and then fixing thereto a single layer of loose chips, the initial profile is retained in its general form. This also applies when two or more layers of loose chips are superposed in order to form the coating, the defects being reproduced in each of the successive layers.

These defects are reflected in a lack of comfort when driving vehicles, in particular at the maximum speeds authorized on the road network.

In addition to the above technique for producing coatings, roads are also repaired by depositing layers of bituminous coated products which are bound to the surface of the road by means of a layer of binding material of very small thickness, generally less than 10% of the total quantity of bitumen used. The coated material, which consists of a mixture of bitumen and aggregates of various particle sizes, has the form of a malleable mass which is spread and compacted on the layer of binding material.

The covering obtained is generally very compact and smooth, and the absence of roughness leads to poor tire adhesion for this type of covering, particularly in wet weather. On the other hand, the spreading and compacting of a relatively homogeneous mass of malleable material on an uneven road generally makes it possible to compensate for the small defects in the roads profile when the covering is sufficiently thick.

French Patent 2,550,248 discloses a mobile device for the cold production and spreading on site of bituminous coated products for surfacing roads. In particular, this machine can permit the production and spreading on site of bituminous concrete consisting of a material with a small particle size, such as sand, mixed with an emulsion of bitumen.

This device, which can travel on a road at high speed and on site at low speed, by virtue of a dual transmission, has several possibilities for receiving or storing solid or liquid materials and for processing them. This integrated device, however, has never been set hitherto for producing coatings for repairing a road.

SUMMARY OF THE INVENTION

The aim of the invention is thus to propose a method for producing a surface coating consisting of aggregates and bitumen, on a surface such as a road. This method includes spreading a layer of bituminous binding material on the surface and at least one layer of aggregates on the layer of binding material and then compacting the layer of aggregates in contact with the layer of binding material. These spreading and compacting operations are performed in succession by a spreader travelling in a displacement direction corresponding to the direction of advance of the site, it being necessary for this method to make it possible to avoid the rejections of loose chips, whether these are operational rejections or postponed rejections, to reduce the traffic noise and the wear of the tires of vehicles travelling on the road, to increase the possibilities of producing the coating as a function of weather conditions, to substantially improve the quality of the covering produced and to make it possible to reprofile the road.

To this end, the aggregates consist of loose chips covered with a mixture, which has a pasty consistency, of bitumen and of pulverulent material. The layer of binding material contains at least 11% of the total quantity of bitumen used for producing the coating. The operations of spreading the bituminous binding material, spreading the aggregates and compacting and surfacing the coating are performed one after the other within a period of less than 5 seconds, the speed of advance of the site being at least ten meters per minute.

The invention also relates to a device which is similar in its general design to the device described in French Patent 2,550,248, but also comprises means which are adapted for producing a coating using the method according to the invention.

The device may be used either for the cold production of covered aggregates, for spreading them on site, for spreading the layer of binding material and for surfacing the covering, or, alternatively, for receiving and spreading hot-produced aggregates, spreading the binding material and surfacing the covering.

In order to make the invention understandable, a description will now be given, by way of non-limiting examples and with reference to the appended figures, of several embodiments of the method according to the invention and of the corresponding device for implementation thereof.

DETAILED DESCRIPTION OF THE INVENTION

Figure 1:
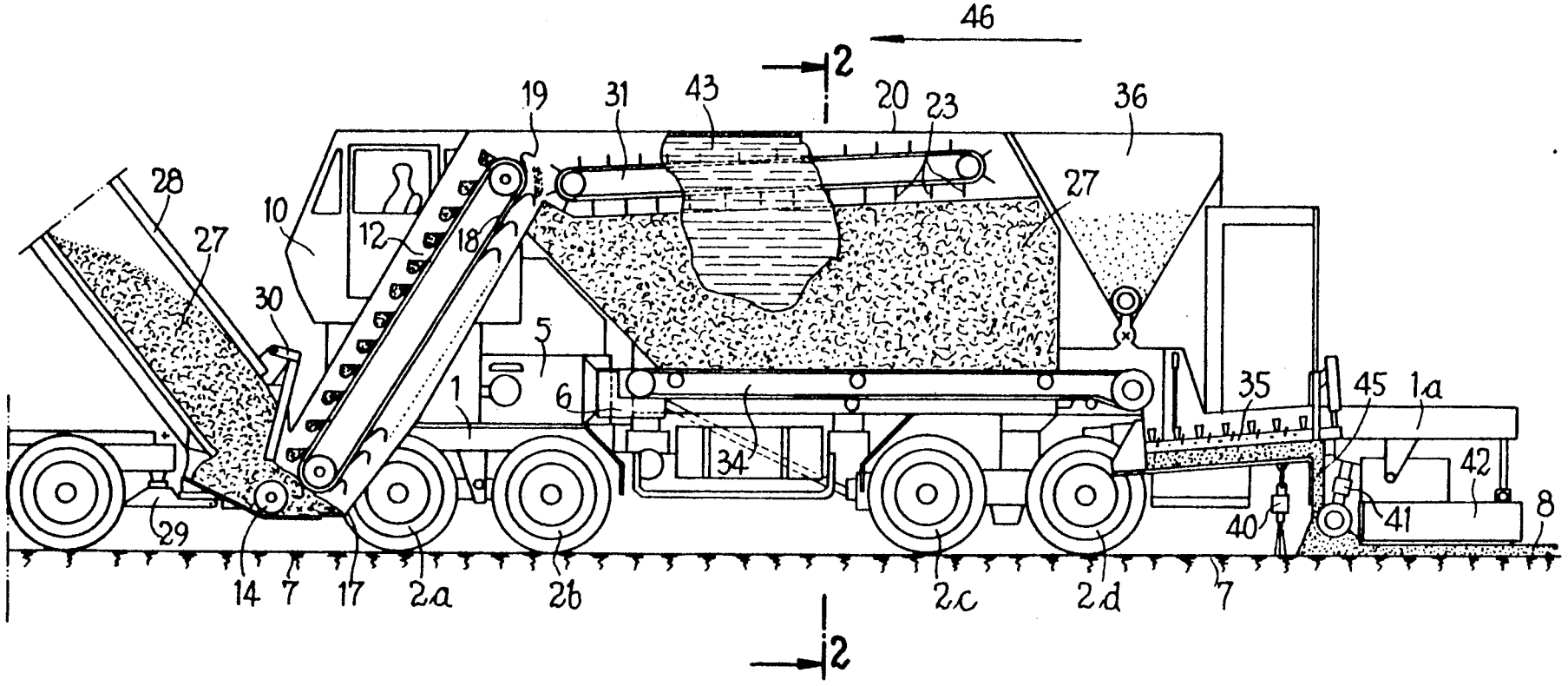
FIG. 1 is a longitudinal sectional view of a mobile machine permitting the, cold production of covered aggregates and the production of surface coating using these aggregates.
Figure 2:
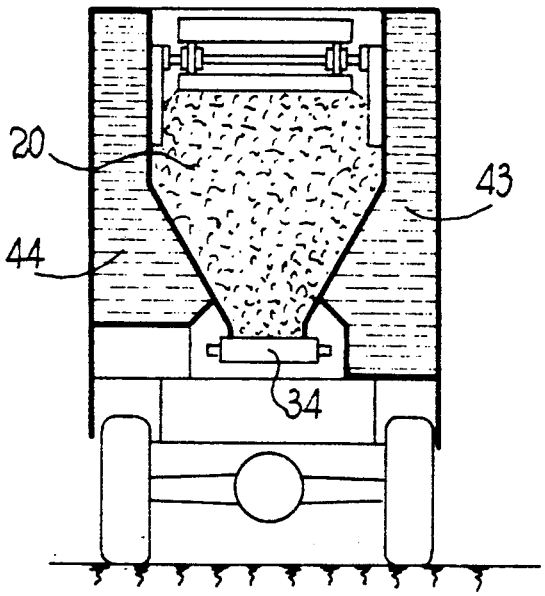
FIG. 2 is a section through 2—2 in FIG. 1.

In FIGS. 1 and 2, the mobile machine of the invention is, in general, similar to the device which is the subject of French Patent 2,550,248.

FIG. 1 shows the device of the invention in its working position on site, and the tipper (or pouring) section of a truck as it supplies loose chips into a hopper of this device.

The device comprises a chassis 1 resting on four sets of wheels 2*a*, 2*b*, 2*c*, 2*d*. The axles of the sets 2*c* and 2*d* are driven by means of drive axles which are operatively connected to a drive unit having a motor 5 associated with a gear box 6. The drive unit makes it possible to move the machine both on the road and on site, and is described in detail in French Patent 2,550,248.

The machine moves over the ground 7 of the site, consisting of the upper surface of a road on which a layer of coating 8 is produced using the method according to the invention.

The chassis 1 carries a control cab 10 whose width is less than half the width of the chassis and which occupies a position which is offset towards one of the lateral sides of the chassis. A bucket elevator 12, inserted between the two side members of the chassis 1, is located in a position which is adjacent to the cab 10 and centrally located relative to the chassis. A receiving hopper 14 is located at the front of the machine just above the ground 7, and is fixed to the ends of the side members of the chassis 1 and communicates with the lower end of the bucket elevator 12. The bucket elevator 12 and receiving hopper 14 together define an automatic feeding mechanism for the machine.

The bucket elevator 12 comprises a housing 17 and a set of buckets carried by two chains 18 which ascend towards the rear of the machine, such that they form an angle of about 60° with the plane of the chassis 1.

An upper part of the chassis 17 communicates, via its discharge opening 19, with the upper part of a hopper 20 for storing granular materials, such as loose chips.

Obviously, the bucket elevator could be replaced by an elevator of another type.

As can be seen in FIGS. 1 and 2, the hopper 20 occupies most of the length of the machine and a substantial part of its width, at least in its upper part. A device, known as a bar leveller, for distributing the loose chips makes it possible to spread the loose chips over the entire length and over the entire width of the storage hopper 20, and is located above the hopper 20 over its entire length.

The bar leveller 31 consists of one or two endless chains trained about end pinions or pulleys and carrying transverse bars 23. The path of the bars of the leveller is very slightly tilted upwards, from front to rear.

Instead of a bar leveller, a screw leveller can be used.

The bucket elevator 12 and the bar leveller 31 are driven, in order to transport the loose chips 27, by hydraulic or electric motors by way of reduction gears (not shown).

A tipper (or pouring) section 28 of a truck, which is adapted to supply loose chips to the machine, is shown in FIG. 1 in its operative position for pouring chips into the receiving hopper 14. The chassis of the truck can be connected via a coupling device 29 to the machine, and the rear gate of the tipper section can be connected to a pivoting hook 30. In this manner, the loose chips 27 are poured in a perfectly controlled manner into the receiving hopper 14 and are then transported by the bucket conveyor 18 to the upper part of the hopper 20 where the bar leveller 31 spreads the loose chips over the entire surface of the hopper 20, which has a large cross-section.

This results in the hopper 20 being filled in a perfectly balanced manner despite its great length and width. The use of a bucket conveyor with a sharp slope makes it possible to lift the materials to a great height, despite the small size of the elevator, in the longitudinal direction of the machine.

Although remaining within regulations applying to the road, the machine may be supplied with chips automatically and comprises a considerable loose-chip storage capacity. As indicated in Patent 2,550,248, this hopper can have a capacity of $10m^3$.

A conveyor belt 34 is disposed under the hopper 20 and removes and measures, in terms of volume, the loose chips in the hopper 20 which are conveyed by the conveyor 34 to above an inlet opening of a mixer 35 into which the loose chips fall. Rollers which drive the conveyor 34 are driven in rotation by a hydraulic motor (not shown).

Pulverulent material, contained in a storage hopper 36, is also poured in a measured quantity into the opening of the mixer 35. The pulverulent material may consist of stone powder or fine sand and may be poured in a measured quantity into the mixer 35 simultaneously with the loose chips 27.

As shown in FIG. 2, the device comprises two lateral reservoirs 43 and 44 located on either side of the storage hopper 20. The reservoirs 43 and 44 are adapted to contain bituminous emulsions which may be different or identical.

A boom 40 for spraying bituminous binding material, consisting of the emulsion contained in one of the reservoirs 43 and 44, is fixed on the lower part of the chassis 1 under the mixer 35 and at the rear of the set of wheels 2*d*.

The emulsion contained in the second reservoir is adapted to be fed into the mixer 35. The mixer 35 then mixes the loose chips coming from the storage hopper 20 with the pulverulent material coming from the hopper 36 and the bituminous emulsion conveyed to the mixer 35 from one of the reservoirs 43 and 44.

The quantities of loose chips, pulverulent material and bituminous emulsion are measured so that aggregates are produced in the mixer 35 which consist of the loose chips covered with bitumen mixed with the pulverulent material in a proportion such that the aggregate has a pasty consistency.

In this aggregate, the proportion of bitumen relative to solid materials is less than 6% and the resulting product is in the form of aggregates which are distinct from one another and not in the form of a pasty mass, as in the case of the production of a bituminous coated product.

Such aggregates, consisting of loose chips covered with bitumen and mixed with a pulverulent material, may hereinafter be called dressed aggregates in order to distinguish them clearly from bituminous coated products which form an amorphous mass consisting of a mixture of the bitumen, aggregates, one or more sands and a pulverulent material, the aggregates being completely bound together by the bitumen, the pulverulent material and the sand which fill all the gaps between the aggregates.

The dressed aggregates are poured onto the surface 7 of the road through the discharge opening of the mixer 35 upstream of a spreading and distributing device 41.

A heating and vibrating surfacing table 42 is fixed in an articulated manner to the rear end 1*a* of the chassis 1, immediately behind the device 41 for distributing the dressed aggregates 45 cold-produced in the mixer 35.

The table 42, of a type which is well-known to road work specialists, compacts and surfaces the aggregates in order to form the layer of coating 8 at the rear of the machine which moves in the direction and the sense of the arrow 46 (FIG. 1), this direction corresponding to the longitudinal direction of the site or road.

The layer of coating 8 is produced in the manner which will be described hereinbelow.

The boom 40 fed with bituminous emulsion from one of the lateral reservoirs of the mobile machine dispenses a layer of bituminous emulsion of constant thickness, by virtue of a set of spraying nozzles uniformly spaced in the direction of the boom 40 corresponding to the transverse direction of the machine, over the entire width of the road or of the carriageway.

It should be noted that the bituminous emulsion is dispensed at the rear of the last set of wheels 2*d*, so that the machine producing the coating never rolls over the layer of emulsion which has just been spread on the surface 7 of the road.

Precise numerical examples will be given hereinbelow in respect of the quantities of bitumen deposited on the surface of the road by the boom 40 for distributing binding material. Generally, these quantities are approximately two to three times smaller than the quantities dispensed during production of a conventional coating using dry loose chips and three times greater than the quantity dispensed to produce the adhesion of a layer of bituminous coated products on the surface of a road.

The dressed aggregates emerging from the mixer 35 are dispensed onto the surface 7 of the road where they are spread in a first stage by the spreading and distributing device which preferably comprises an endless screw device 41.

The vibrating and heating table 42 or finishing table compacts and surfaces the dressed aggregates which have just been dispensed onto the layer of bituminous binding material.

The boom 40 for spraying the binding material, the zone in which the dressed aggregates 45 are dispensed, and the finishing table 42 are disposed close together, one after the other, at the rear part of the machine for producing the coating, which moves in the direction of the arrow 46.

The distance between the boom 40 and the rear part of the finishing table 42 is such that, bearing in mind the speed of the machine corresponding to the speed of advance of the site, there are never more than five seconds between the spreading of the bituminous binding material on the surface 7 of the road and the completion of compacting and surfacing of the coating on the corresponding part of the road.

The three operations of spreading the binding material, spreading the dressed aggregates, and compacting are thus performed in under five seconds on any part of the road.

Moreover, the speed of advance of the site, which corresponds to the speed of the machine in the direction of the arrow 46, is always greater than a value which is approximately equal to ten meters per minute, it being possible for this speed of advance to be of the order of twenty to twenty-five meters per minute.

This speed, which is much higher than the speed of advance of a finisher, in the case of the production of a layer of covering consisting of the prior art bituminous coated products, makes it possible to obtain a particularly good surfacing quality and a very effective reprofiling of the road during repair.

This advantage is obviously in addition to those advantages connected with the increase in productivity of the installation.

The road is reprofiled by virtue of the formation of a coating which comprises a different number of superposed layers of loose chips according to the zones of this road which may comprise profile defects which are reflected in hollows of a considerable depth.

In fact, the surfacing performed by the finishing table makes it possible to obtain a layer of coating whose upper surface is perfectly planar, because the hollows in the road are filled by a number of layers of superposed dressed aggregates which is sufficient to compensate for the level of the upper surface of the layer of coating. The aggregates in the successive layers bear directly on one another, which makes it possible to produce a material for filling those cavities which cannot be pressed out.

The dressed aggregates are covered with a pasty layer which is both adhesive and lubricating, and are placed, without difficulty, on the surface of the road or on a lower layer of aggregates by sliding which is enhanced by the dressing layer. The speed of displacement, which is greater than ten meters per minute, of the finishing table makes it possible to enhance the displacement and placing of the layers of aggregates.

Compacting the aggregates affords an efficient adhesion and binding of these aggregates on the layer of binding material spread over the surface of the road.

The dressed aggregates coated with a pasty and adhesive layer based on bitumen are immediately fixed, one on top of the other, at the time of compacting, so well that any operational rejection is prevented. Moreover, compacting is greatly facilitated by the fact that the loose chips are coated with a lubricating bituminous layer. It is thus possible to use the road for vehicular traffic very soon after the production of the coating.

The coating obtained makes it possible to reduce the vehicle traffic noise as the surface roughness of the loose chips no longer exists and as the cavities between the loose chips absorb the sound waves.

These characteristics, together with the excellent profiling of the road, permit a substantial increase in comfort for motorists.

No loose chips are thrown up, and the drawbacks associated therewith are thus eliminated.

Even though it has very good rolling qualities, the coating obtained using the process according to the invention provides good adhesion for vehicles, even in wet weather, as it has roughness and surface cavities.

Figure 3:
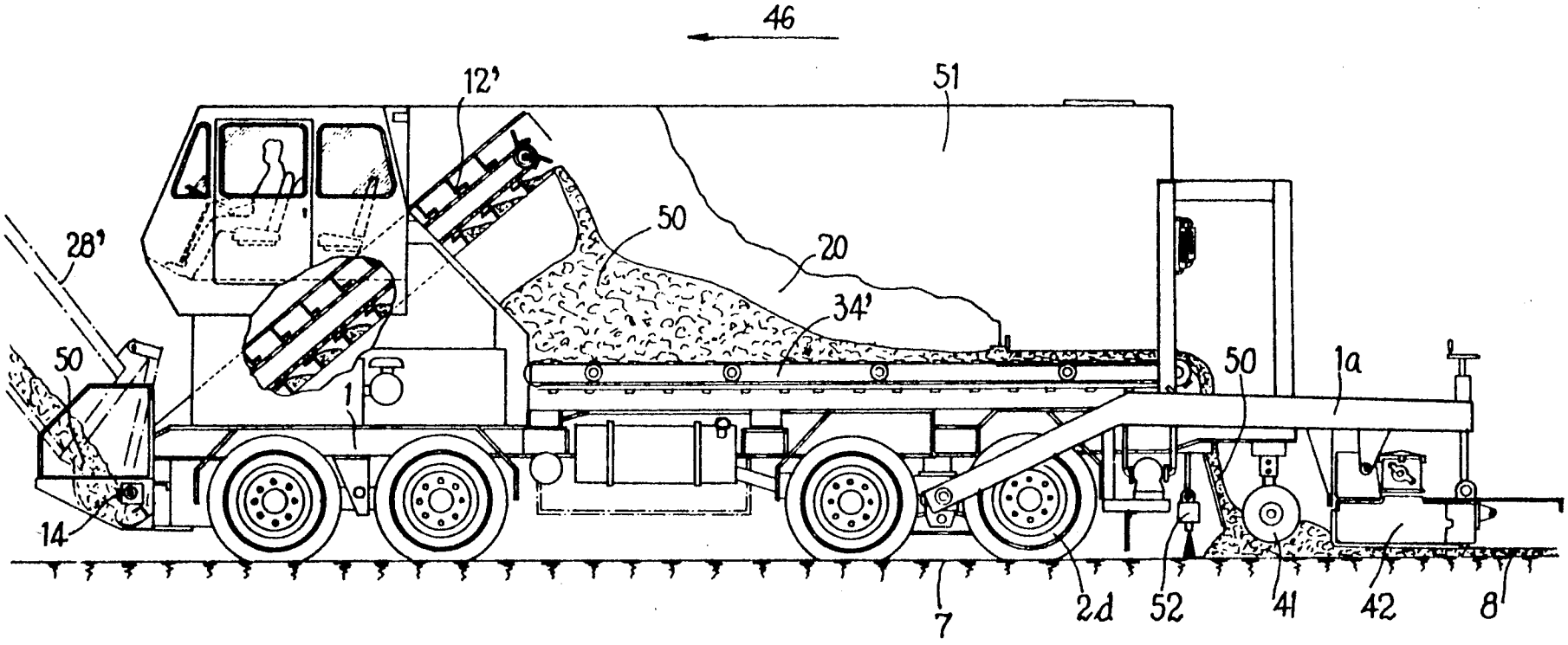
FIG. 3 is a longitudinal sectional view of a mobile machine permitting the production of a surface coating using hot-produced aggregates.

FIG. 3 shows an alternative embodiment of the device described hereinabove and shown in FIGS. 1 and 2.

The device shown in FIG. 3, whose general structure is similar to that of the mobile device described in French Patent 2,550,248, is intended to be used for producing a coating according to the invention of dressed aggregates produced by hot mixing of dried and heated loose chips, bitumen and pulverulent material in an installation performed by other than the machine which produces the coating.

The dressed aggregates can be produced, for example, in a conventional hot-coating drum and then transported to the site by dump trucks which are fixed to the front of the coating machine at the hopper 14 in order to pour the hot dressed aggregates into this hopper from the pouring section 28' of the truck. This operation is performed in the same manner as the pouring of the loose chips 27 in the embodiment of FIG. 1.

The dressed aggregates 50 poured into the hopper 14 carried upwardly by a bar conveyor 12' and then poured into the central hopper 20 at the discharge end of the conveyor 12'.

A rung conveyor 34' transports the hot dressed aggregates to the rear of the machine where the aggregates 50 are dispensed onto the surface 7 of the road.

As in the case of the device shown in FIGS. 1 and 2, the central hopper 20 may comprise a bar leveller or a screw leveller similar to the leveller 31 in order to increase the storage capacity of the hopper 20.

It is not necessary for the machine shown in FIG. 3 to include a mixer since the dressed aggregates are hot-produced in a different machine.

The hopper 36 for storing pulverulent material in the first embodiment is replaced, in this second embodiment, by a tank 51 intended to contain the bituminous binding material which may consist of an emulsion.

The device shown in FIG. 3 includes lateral reservoirs similar to the reservoirs 43 and 44 of the device shown in FIGS. 1 and 2. These reservoirs, and the tank 51, can contain bituminous binding material, such as an emulsion, intended to be spread over the surface 7 of the road, using a variable width spreading boom 52 fixed to the chassis 1 of the machine at the rear of the rear set of wheels **2*d***. The machine's capacity for storing bituminous binding material is thus greatly increased and, moreover, only one type of emulsion is required to produce the layer for catching the dressed aggregates.

In a machine which has a chassis width of 2.50 m, a height of 4 m and a length of 11 m, and which is constructed in accordance with this embodiment of the invention, a 15-ton aggregate reserve can be disposed in the central hopper and a 12-ton binding material reserve can be stored in the lateral reservoirs and in the rear tank 51.

This makes the machine very independent, enabling it to operate normally even when the supply from the trucks is irregular.

Under normal operating conditions, the tanks of binding material in emulsion need to be resupplied only once during the day's work on the site.

As in the machine shown in FIGS. 1 and 2, the rear part **1*a* of the chassis 1 of the machine shown in FIG. 3 carries a vibrating and heating finishing table 42. The table 42** is mounted in an articulated manner on the chassis by means of a three point hitch.

The boom 52 for spreading the binding material and the finishing table 42 are located on the rear part of the chassis 1 so that no more than 5 seconds elapses between the spreading of the binding material on the surface 7 of the road by the boom 52 and the end of compacting and surfacing performed by the finishing table 42, bearing in mind the speed of advance of the machine.

The hot dressed aggregates 50 are poured out at a point located between the spreading boom 52 and the finisher 42, and slightly in front of an endless-screw distribution device 41.

The dressed aggregates are at a temperature which is generally greater than 120° C. and which may be in the region of 150° C. when they are spread over the layer of bituminous binding material dispensed by the boom 52 over the surface 7 of the road.

As with the machine shown in FIGS. 1 and 2, the speed of advance of the machine shown in FIG. 3, in the direction and the sense of the arrow 46, must be greater than ten meters per minute in order to obtain a perfectly surfaced layer of coating 8 providing an effective re-profiling of the road.

In the coating method according to the invention which is utilized with the device shown in FIG. 3, the advantages are at least equivalent to the advantages obtained when implementing the method by making use of the machine shown in FIGS. 1 and 2.

The quantity of bitumen contained in the layer of binding material spread over the road before the spreading of the dressed aggregates is slightly less than the quantity of bitumen poured over the road in order to produce the adhesion of dry loose chips in the prior art, and can, in fact, be two to four times less.

The dressed aggregates are covered with a relatively thick and pasty layer consisting of bitumen and pulverulent material. 2 to 6% of bitumen and, as pulverulent material, either 4 to 5% by weight of stone powder or 10 to 20% of fine sand is incorporated with the loose chips.

The function of the stone powder or the sand is only to make the fluid bitumen pasty and to thicken the adhesive layer so that the loose chips adhere together in a thicker layer.

This is a very important idea, since the bitumen-coated loose chips are surrounded only by a thin film of hot bitumen, which is thus very fluid and which has a tendency to flow.

The stone powder (or the fine sand) is added only to make the bitumen, which is too fluid, pasty and to thicken the layer of binding material, which is much too thin to guarantee durable binding between the particles.

The thickening agent added is thus added for a dual purpose:

it is a thickener in the geometric sense of the word; and it is a thickener in the sense that it increases the consistency.

By way of the example, the composition of a surface coating according to the prior art, comprising two superposed layers (two-layer coating) and the composition of a coating according to the invention will be given hereinbelow.

The surface coating according to the prior art comprises a first layer of bitumen emulsion spread at the rate of 1.1 kg/m$^2$, that is to say 0.8 kg of pure bitumen per square meter.

A first layer of loose chips with a large particle size is spread over the layer of emulsion. This first layer comprises 7 kg of large loos chips per square meter.

A second layer of emulsion is spread over this first layer of loose chips at the rate of 1.5 kg of emulsion per square meter, that is to say 1 kg of pure bitumen per square meter.

A second layer of loose chips with a fine particle size is spread over this second layer of emulsion at the rate of 8 kg of fine loose chips per square meter.

The coating according to the prior art undergoes compacting, after which a relatively large proportion of loose chips are not sufficiently bound to the surface of the road by the bituminous binding material, such that these loose chips risk being thrown up when vehicles pass by.

The coating method according to the invention, given by way of example, consists in spreading a layer of bitumen emulsion over the surface of the road at the rate of 0.95 kg of emulsion per square meter, i.e. 0.60 kg of pure bitumen per square meter.

A layer of dressed loose chips is spread over this layer of emulsion at the rate of 22 kg of dressed loose chips per square meter. The dressed loose chips are dispensed onto the layer of bituminous binding material immediately after it is applied and the layer of dressed loose chips is actually compacted and smoothed immediately after the spreading of the dressed loose chips.

The quantity of bitumen covering the dressed loose chips is 1.4 kg per square meter of coating. The bitumen covering the dressed aggregates is thickened by being mixed with 5 to 6 kg of fine sand or 1 to 2 kg of stone powder per square meter of coating.

The total quantity of bitumen relative to the solid materials is thus in the region of 5%, which represents approximately the upper limit of the proportion of bitumen spread on the loose chips for forming the dressed aggregates according to the invention.

The table given hereinbelow shows the various quantities of materials used to produce the coating according to the prior art and according to the present invention.

| | Coating according to the prior art (two-layer) | Coating according to the invention |
|---|---|---|
| Total quantity of bitumen | 1.8 kg/m$^2$ | 2.00 kg/m$^2$ |
| Quantity of bitumen spread over the ground | 1.8 kg/m$^2$ | 0.60 kg/m$^2$ |
| Quantity of bitumen used to dress the aggregates | 0 | 1.4 kg/m$^2$ |
| Total thickness of the covering | 15 mm at any point | 10 to 40 mm depending on the defects of the old support |
| Total quantity of loose chips used (per m$^2$) | 17 kg of large loose chips + 8 kg of small loose chips = 25 kg | 22 kg of medium-sized loose chips |
| Other additives | if appropriate, adhesion additive at the loose chips/binding material interface | an obligatory 5 to 6 kg of fine sand or 1 to 2 kg of stone powder in order to thicken the bitumen |
| Total quantity of solid material of mineral origin | 25 kg | 23 to 28 kg |

Obviously, these values are only indicative and the invention may be implemented by using quantities of materials or relative proportions of these materials which are different from those which have been indicated in the example given hereinabove.

The quantity of bituminous binding material used to produce the dressed aggregates from loose chips may be a good deal less than the quantity indicated hereinabove which corresponds substantially to the upper limit for implementation of the invention. However, the quantity of bitumen used for dressing the aggregates must be sufficient to avoid any rejection and any ejection of loose chips after production of the coating.

The quantity of bitumen used for dressing the loose chips must represent at least 11% of the total quantity of bituminous binding material used per square meter of finished coating.

In other words, the bitumen contained in the bituminous binding material spread over the surface of the road before spreading of the dressed aggregates may represent up to 89% of the total quantity of bitumen.

Moreover, in order to produce satisfactory binding with the road, the quantity of bitumen contained in the binding material must not be less than 11% of the total quantity of bitumen used per square meter of coating. The aggregates may thus contain up to 89% of the total quantity of bitumen used.

Currently, the quantity of bitumen contained in the binding material is greater than 20% of the total quantity of bitumen used. This quantity of bitumen in the binding material is preferably in the region of 30% of the total quantity of bitumen used.

The proportion of bitumen relative to the weight of solid materials, that is to say the weight of loose chips and of pulverulent material, is generally between 2 and 6%.

Obviously, the method according to the invention may be implemented by making use of a bituminous binding material other than an emulsion and, for example, by making use of the bitumen incorporated in a solvent or, alternatively, of hot liquid bitumen.

The method according to the invention can be implemented regardless of the particle size of the loose chips used to form the coating, within the limit of the particle sizes usually used to produce coatings according to the prior art.

Instead of crushed rock loose chips, use may advantageously be made of crushed products from the demolition of old bituminous road layers, these recycled products generally being known as millings. In this case, in addition to the advantage which consists in using a product which normally has to be stored or removed, material is saved both in respect of the loose chips and bitumen used in the method according to the invention. In fact, the layer of solid bitumen which remains fixed to the milling to form the pasty coating for the aggregates.

The method according to the invention may be implemented by making use of machines which are slightly different from those which have been described. The totally integrated design of these machines for producing and laying a coating makes it possible, however, to implement the invention under optimum conditions, avoiding any error in adjustment of the parameters required for producing a coating of satisfactory quality.

What is claimed is:

1. A method for producing a surface coating on a surface, comprising the steps of:

spreading a layer of bituminous liquid binding material on the surface;

spreading a layer of aggregates, comprising loose chips covered with a pasty mixture of bitumen and pulverulent material, over said layer of bituminous liquid binding material;

compacting said layer of aggregates against said layer of bituminous liquid binding material;

wherein said steps of spreading said layer of binding material, spreading said layer of aggregates and compacting said layer of aggregates are performed successively along a particular direction of advance within a period of five seconds or less for any given portion of said surface coating; and wherein said layer of binding material contains at least 11 percent and no more than 89 percent by weight of the total quantity of bitumen present in said surface coating.

2. A method as recited in claim 1, wherein said steps of spreading said layer of binding material, spreading said layer of aggregates, and compacting said layer of aggregates are performed along said direction of advance at a rate of at least 10 meters per minute.

3. A method as recited in claim 2, wherein said layer of binding material contains at least 20 percent by weight of the total quantity of bitumen present in said surface coating.

4. A method as recited in claim 3, wherein said layer of binding material contains about 30 percent by weight of the total quantity of bitumen present in said surface coating.

5. A method as recited in claim 1, wherein said layer of binding material contains at least 20 percent by weight of the total quantity of bitumen present in said surface coating.

6. A method as recited in claim 5, wherein said layer of binding material contains about 30 percent by weight of the total quantity of bitumen present in said surface coating.

7. A device for producing a surface coating, formed of aggregates and bitumen, on a surface, comprising:

a chassis having a forward end and a rearward end;

a plurality of rolling means spaced longitudinally along said chassis for supporting said chassis such that it can roll along a particular direction of advance;

means for moving said chassis along said direction of advance;

a receiving hopper mounted on said chassis near said forward end thereof for receiving chips;

a storage hopper mounted on said chassis at a central part thereof for storing the chips;

elevator means for conveying the chips upwardly from said receiving hopper and into said storage hopper;

conveyer means for conveying the chips rearwardly from said storage hopper;

at least one reservoir mounted on said chassis for containing liquid bituminous binding material;

spraying means, mounted rearwardly of the rearwardmost of said rolling means, for spraying the liquid bituminous binding material from said at least one reservoir onto the surface as said chassis is being moved forwardly in said direction of advance;

discharge means, disposed rearwardly of said spraying means, for discharging the chips from said conveyer means onto the surface after it has been coated with the liquid bituminous binding material by said spraying means, as said chassis is being moved forwardly in said direction of advance; and a finishing table, suspended in an articulated manner from said chassis at a location rearward of said spraying means, for compacting the chips discharged onto the surface against the binding material sprayed onto the surface as said chassis is being moved forwardly in said direction of advance.

8. A device as recited in claim 7, wherein said receiving hopper is adapted to receive loose chips; and a mixing means is mounted rearwardly of said conveyer means for mixing loose chips conveyed by said conveying means with liquid bituminous material from said at least one reservoir in order to form an aggregate.

9. A device as recited in claim 8, further comprising an additional hopper mounted on said chassis and having an outlet located above a rearward end of said conveyer means, said additional hopper being adapted to store pulverulent material and discharge the pulverulent material from said outlet onto said conveying means.

10. A device as recited in claim 9, wherein said at least one reservoir comprises two reservoirs arranged on laterally opposing sides of said storage hopper.

11. A device as recited in claim 10, further comprising a levelling means for levelling the chips stored in said storage hopper.

12. A device as recited in claim 11, wherein said levelling means comprises a conveyer mounted in an upper portion of said storage hopper and having levelling bars conveyed therealong.

13. A device as recited in claim 7, further comprising an additional hopper mounted on said chassis and having an outlet located above a rearward end of said conveyer means, said additional hopper being adapted to store pulverulent material and discharge the pulverulent material from said outlet onto said conveying means.

14. A device as recited in claim 7, wherein said at least one reservoir comprises two reservoirs arranged on laterally opposing sides of said storage hopper.

15. A device as recited in claim 7, further comprising a levelling means for levelling the chips stored in said storage hopper.

16. A device as recited in claim 15, wherein said levelling means comprises a conveyer mounted in an upper portion of said storage hopper and having levelling bars conveyed therealong.

17. A device as recited in claim 7, wherein said receiving hopper is adapted to receive chips premixed with bituminous binding material; and said discharge means is defined by a rearward end of said conveying means.

* * * * *